United States Patent [19]

Parks

[11] 4,367,431

[45] Jan. 4, 1983

[54] MULTISTAGE SPARK GAP WITH DELAY CABLES

[76] Inventor: John D. Parks, 10700 Greene Dr., Lorton, Va. 22079

[21] Appl. No.: 169,003

[22] Filed: Jul. 15, 1980

[51] Int. Cl.[3] ..... H01J 7/44; H01J 17/34; H01J 23/16; H01J 29/96; H01K 1/62

[52] U.S. Cl. ..... 315/38; 313/234; 313/325; 361/118; 315/36

[58] Field of Search ..... 315/36, 37, 38; 313/231.4, 325; 361/118, 119

[56] References Cited

U.S. PATENT DOCUMENTS

| | | | |
|---|---|---|---|
| 3,312,868 | 4/1967 | Vodicka | 361/119 |
| 3,447,032 | 5/1969 | Romanowski et al. | 315/36 X |
| 3,934,175 | 1/1976 | Clark | 361/118 |
| 4,142,220 | 2/1979 | Lundsgaard | 361/119 |
| 4,160,210 | 7/1979 | Molinari | 361/119 |
| 4,262,317 | 4/1981 | Baumbach | 361/119 |

*Primary Examiner*—Saxfield Chatmon, Jr.
*Attorney, Agent, or Firm*—Nathan Edelberg; Robert P. Gibson; Saul Elbaum

[57] ABSTRACT

The spark gap device disclosed herein comprises at least two sets of electrodes enclosed within a common chamber. A delay line is connected between successive sets of electrodes. An arc which develops across the first set of electrodes as a result of a voltage transient ionizes the gas in the chamber. The voltage transient is delayed by the time required to travel through the delay line. When the voltage transient arrives at the second set of electrodes, an arc develops in less time than was required at the first set of electrodes due to the fact that the gas in the chamber has been at least partially ionized.

3 Claims, 6 Drawing Figures

MULTISTAGE SPARK GAP WITH DELAY CABLES

RIGHTS OF THE GOVERNMENT

The invention described herein may be manufactured, used and licensed by or for the U.S. Government for governmental purposes without the payment to me of any royalty thereon.

BACKGROUND OF THE INVENTION

Spark gaps are devices used to protect electrical and electronic equipment from damaging voltage transients caused by lightning, nuclear electromagnetic pulses, or switching and line faults. The problem that has remained unsolved by prior art devices is that of developing an arc in the spark gap rapidly enough to prevent the leading edge of fast rising voltage transients from bypassing the spark gap and damaging the equipment. The single stage spark gaps known in the art have not been effective to solve this problem.

Accordingly, it is an object of the invention to overcome this disadvantage of the prior art devices.

Specifically, it is an object of this invention to provide a spark gap device effective to prevent bypass of fast rising voltage transients, thereby protecting electrical and electronic equipment from damage caused thereby.

SUMMARY OF THE INVENTION

This invention comprises a multistage, single chamber spark gap with a delay line. The voltage transient is first applied to a first set of electrodes, thereby forming an arc across these electrodes. This arc at least partially ionizes the gas within the chamber. The voltage transient is then delayed by the time required to travel through the delay line. When the voltage transient arrives at a second set of electrodes within the chamber, an arc will very rapidly develop thereacross due to the fact that the gas in the chamber is already ionized. The arc develops across the second set of electrodes in less time than was required at the first set of electrodes. This is also substantially less time than is required in conventional single stage spark gaps.

DESCRIPTION OF THE PREFERRED EMBODIMENT

Figure 1:
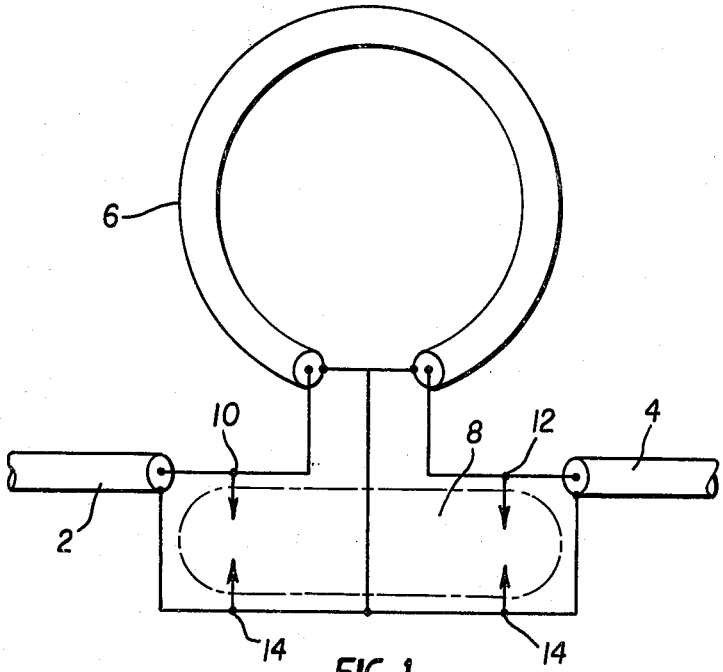
FIG. 1 is a schematic illustration of the spark gap of the present invention.

In FIG. 1, reference numeral 2 indicates what will here be termed the input to the spark gap device. This is represented by a coaxial conductor, but it is to be understood that the invention is not limited to use with coaxial conductors. The input may be connected to an antenna, for example, which is well known to be susceptible to being struck by lightning. The output 4 is normally connected to electronic or electrical equipment of various types, such as televisions, radios, etc. A portion of one of the conductors of the coaxial cable comprises a delay line 6.

Reference numeral 8 denotes an enclosure or chamber which contains a gaseous medium. The preferred medium is a combination of neon and argon gases. Such a combination is readily ionizable and sustains great current. Electrodes 10 and 12 are positioned within the chamber and are connected to one of the conductors at opposite ends of the delay line 6. Electrodes 14 are also contained within the chamber, and are connected to the other of the conductors. The electrodes 14 form pairs with the electrodes 10 and 12, respectively. In FIG. 1, electrodes 14 are illustrated as distinct and separate elements, but they may readily be formed as one and the same element, as will be described with respect to subsequent figures.

In operation, a voltage transient arriving at input 2 will result in the development of an arc across electrodes 10 and 14. This arc will partially or fully ionize the gaseous medium within the chamber 8. The voltage transient will then be delayed by the time required to travel through the delay line 6. When the transient arrives at electrode 12, a second arc will be formed across electrodes 12 and 14. This arc will form very rapidly due to the fact that the gas within the chamber is already ionized. The time required to form this second arc is greatly reduced with respect to the time required to form an arc across conventional spark gap devices, thereby resulting in more effective protection for the electronic equipment attached to the output 4.

Figure 2:
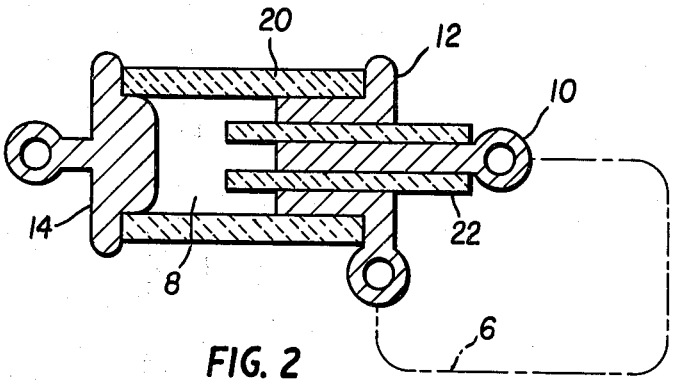
FIG. 2 illustrates a first form of a suitable embodiment of the spark gap of the present invention.

FIG. 2 illustrates an embodiment of the invention suitable for use with many types of conductors. The figure represents a sectional view through a cylindrically shaped chamber. Electrode 14, common to both stages of the spark gap, forms an end cap for the chamber 8. A tubular ceramic element 20 both separates and electrically insulates electrode 12 from the common electrode 14. Electrode 10 is positioned concentrically within electrode 12 and is insulated therefrom by means of ceramic sleeve 22. Reference numeral 6 indicates the path of the delay line in this embodiment.

Due to the concentric arrangement of the electrodes 10 and 12, the embodiment of FIG. 2 reliably and efficiently assures that the arc across the second stage of the device will form extremely rapidly. The arc of the first stage will form between electrodes 10 and 14 along the axis of chamber 8. Since the axis is in close proximity to all portions of the chamber which are adjacent the electrode 12, the gas in these portions will be thoroughly ionized, assuring the rapid formation of the arc in the second stage.

Figure 3A:
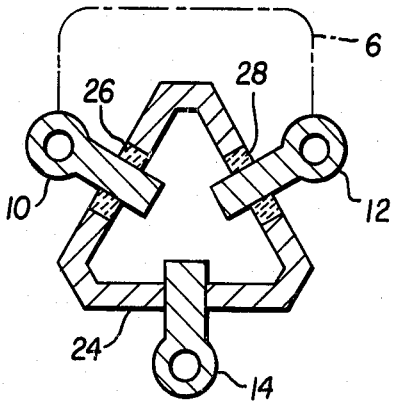
FIGS. 3A and 3B are views of a second embodiment of the spark gap of the present invention.
Figure 3B:
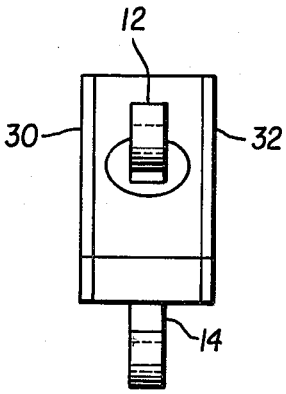

FIG. 3A represents a second form of the present invention. In this embodiment a tubular metallic extrusion 24 forms the chamber for the spark gap device. Common electrode 14 is attached to the tubular portion of the chamber. Electrodes 10 and 12 are insulated from the electrode 14 and from one another by means of ceramic sleeves 26 and 28 embedded in the tubular extrusion. End caps 30 and 32, as shown in FIG. 3B, form the remaining walls of the enclosure. Since the gap between electrodes 10 and 14 is relatively close to the gap between electrodes 12 and 14, the arc resulting from a voltage gradient across the first set of electrodes 10 and 14 will assure ionization of the gas in the region of electrodes 12 and 14.

Figure 4:
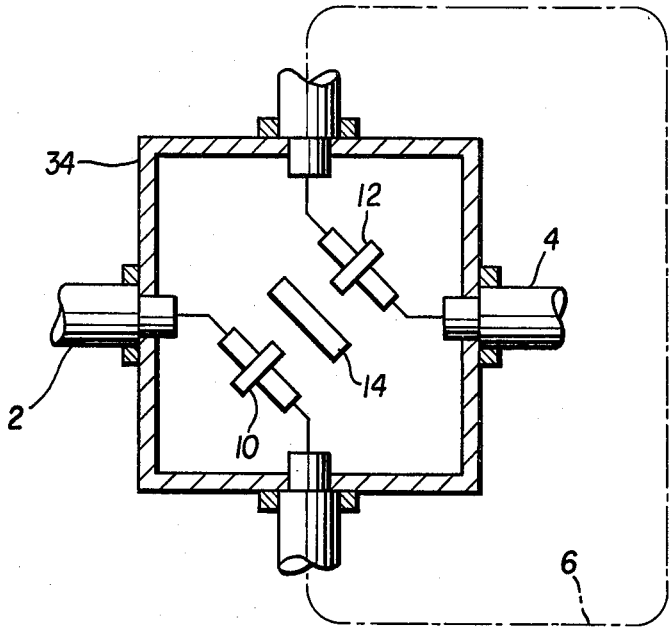
FIG. 4 is an illustration of an embodiment of the invention which is particularly suitable for use with coaxial conductors.

FIG. 4 illustrates a form of the invention which is especially suited for use with coaxial conductors. Input 2 and output 4, as well as the delay line 6 take the form of coaxial cables in this embodiment. Reference numeral 34 represents a metallic enclosure or box-like element. The coaxial cables are secured to the enclosure 34 by conventional couplings in such manner to assure that the outer conductors thereof are in electrical contact with the enclosure. This forms a common terminal for the outer conductors of these cables, the electrode 14 being in contact with this common terminal as a result of its being secured to the box 34.

The inner conductor of the coaxial input 2 is in electrical contact with the electrode 10. Electrode 10 is suspended within the enclosure 34 so as not to contact any portion thereof. Electrode 10 is in turn connected to the inner conductor of the delay line 6, thereby causing the voltage transient to pass through the delay line to the electrode 12. Electrode 12 is also insulated electrically from the enclosure 34. The inner conductor of the output 4 is also connected to the electrode 12.

Figure 5:
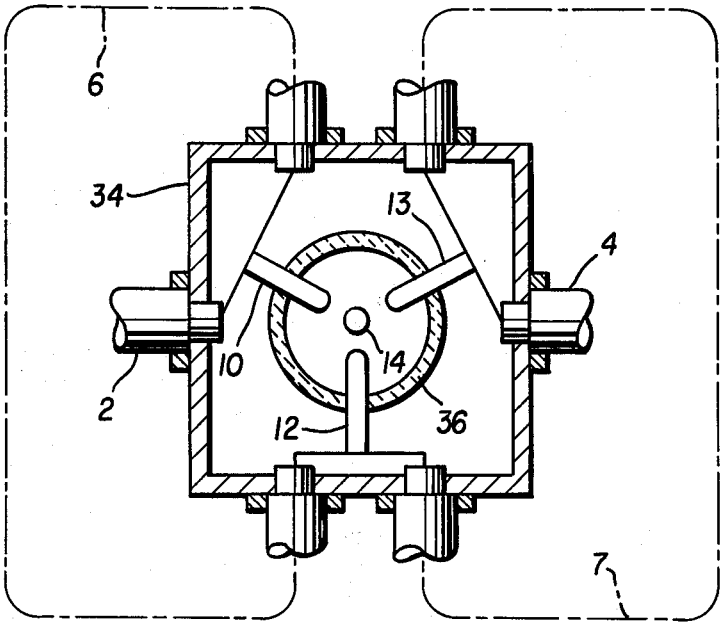
FIG. 5 illustrates a form of the invention which comprises more than two distinct stages.

FIG. 5 illustrates an embodiment of the invention which is similar to that of FIG. 4 but comprises more than two stages for the spark gap device. As in FIG. 4, the coaxial input, output and delay lines are connected to the metallic enclosure 34 in such manner that the outer conductors of the coaxial cables are in electrical contact therewith. The inner conductors of the respective cables are electrically insulated from the enclosure 34, as are the electrodes 10, 12 and 13. Common electrode 14 is in electrical contact with the common terminal formed by the box 34.

In operation of the embodiment of FIG. 5, a voltage transient arriving at input 2 will cause an arc to develop across electrodes 10 and 14, as previously described. The transient must then travel through the delay line 6 before reaching electrode 12, as also previously described. The embodiment of FIG. 5 comprises a second delay line 7 which causes the voltage transient to travel therethrough to the third electrode 13. The arc across the gap formed by electrodes 13 and 14 will most assuredly develop in extremely rapid fashion due to the fact that the gas within the chamber has been ionized by the arcs formed in the prior two stages (the gaps at 10–14 and 12–14).

Reference numeral 36 in FIG. 5 illustrates an optional ceramic ring which may be included in the device to support the electrodes 10, 12 and 13. In addition to adding structural support, the ring 36 acts to further confine the space within which the gaseous medium is contained, thereby reducing the volume of gas which must be ionized and assuring more efficient operation of the device.

While a two-stage spark gap is sufficient to adequately protect equipments used in most applications, in situations where greater protection is deemed necessary three or more stages may be provided. It should be understood that an embodiment of the invention comprising three or more stages is not limited to the configuration shown in FIG. 5 which is particularly adapted with coaxial conductors. An embodiment of the invention comprising three or more stages might also be formed in a fashion similar to that shown in FIGS. 2 and 3A–3B, suitable for use with virtually any type of conductor.

While the invention has been described with reference to the accompanying drawings, I do not wish to be limited to the details shown therein as obvious modifications may be made by one of ordinary skill in the art.

I claim:

1. A spark gap means comprising:
an insulating enclosure having first and second ends;
an electrode in said one end of said enclosure;
a coaxial electrode set in said second end of said enclosure, wherein said set includes two concentric electrodes, one within the other, and insulation therebetween;
a delay line connected between said two electrodes of said set.

2. A spark gap means for a coaxial cable having several portions and having an inner and an outer conductor in each portion, said means including:
a metallic enclosure with the outer conductors of first and second coaxial cable portions respectively connected to first and second positions on said enclosure, and a delay line coaxial cable portion having two ends, with the outer conductor of said ends connected to third and fourth positions on said enclosure;
a first electrode in said enclosure connected thereto;
second and third electrodes in said enclosure, with the inner conductor of said first coaxial cable portion and the inner conductor of one end of said delay line coaxial cable portion connected to said second electrode and with the inner conductor of said coaxial cable second portion and with the inner conductor of the other end of said coaxial cable delay line portion connected to said third electrode; and
a readily ionizible gaseous medium in said enclosure.

3. A spark gap means for a coaxial cable having several portions and having an inner and an outer conductor in each portion, said means including:
a metallic enclosure with the outer conductors of first and second coaxial cable portions respectively connected to first and second positions on said enclosure, and first and second delay line coaxial cable portions each having two ends, with the outer conductors of said ends connected to third, fourth, fifth, and sixth positions on said enclosure;
a first electrode in said enclosure connected thereto;
second, third, and fourth electrodes in said enclosure, with the inner conductor of said first coaxial cable portion and the inner conductor of one end of said fist delay line coaxial cable portion connected to said second electrode, with the inner conductor of said second coaxial cable portion and the inner conductor of one end of said second delay line coaxial cable portion connected to said third electrode, and with the inner conductors of the other ends of both said first and second delay line coaxial delay line portions connected to said fourth electrode; and
a readily ionizible gaseous medium in said enclosure.

* * * * *